United States Patent [19]

O'Connor et al.

[11] Patent Number: 4,781,088

[45] Date of Patent: Nov. 1, 1988

[54] PNEUMATIC SCRAP REDUCTION SYSTEM FOR ROTARY DIE CUTTER

[75] Inventors: Barry J. O'Connor, Anderson, Ind.; Robert B. Vigder, Dayton, Ohio

[73] Assignee: Corfine Inc., Muncie, Ind.

[21] Appl. No.: 137,489

[22] Filed: Dec. 23, 1987

Related U.S. Application Data

[63] Continuation-in-part of Ser. No. 51,262, May 5, 1987, Pat. No. 4,716,802, which is a continuation of Ser. No. 817,720, Jan. 20, 1986, abandoned.

[51] Int. Cl.[4] ..... B26D 1/62; B26D 5/00; B65H 20/32

[52] U.S. Cl. ..... 83/38; 83/313; 83/336; 226/145; 226/148; 101/228

[58] Field of Search ..... 83/38, 313, 336; 226/113, 114, 115, 117, 145, 148; 101/153, 228, 226, 224, 230

[56] References Cited

U.S. PATENT DOCUMENTS 4,716,802 1/1988 O'Connor et al. ..... 83/313

*Primary Examiner*—Donald R. Schran

*Attorney, Agent, or Firm*—Biebel, French & Nauman

[57] ABSTRACT

A rotary die cutter system minimizes the amount of scrap between successive blanks cut from web material by holding the web against backward movement at a position spaced upstream from the nip defined by the die and anvil cylinders, retracting the cut leading end of the web through a predetermined distance by means of a fluid pressure cylinder in response to release of the web by the cut-off knife at the trailing edge of the die on the die cylinder such that on the next cycle, the leading edge of the die will engage the web at a position spaced so close to the retracted leading end of the web that contiguous portions of a single blank can be cut from the web during successive revolutions of the die cylinder.

5 Claims, 5 Drawing Sheets

PNEUMATIC SCRAP REDUCTION SYSTEM FOR ROTARY DIE CUTTER

REFERENCE TO RELATED APPLICATIONS

This application is a continuation-in-part of our application Ser. No. 51,262, filed May 5, 1987, now U.S. Pat. No. 4,716,802 as a File Wrapper Continuation of Ser. No. 817,720, filed Jan. 20, 1986 abandoned.

BACKGROUND OF THE INVENTION

This invention relates to a rotary die cutting system which is fed by web stock and more particularly to a system for reducing the scrap material produced by rotary die cutters between successive blanks treated or cut from the web.

In conventional rotary die cutter systems, wherein the web stock is fed by powered pull rolls operating in synchronism with the die and anvil cylinders, the web is fed intermittently to maintain approximately the same accumulated loop of web material.

One of the problems with this conventional technique is that after the trailing edge of the die, which includes a cut-off knife, has cut off the portion of the web which passed between the die and the anvil cylinders, momentum tends to feed the cut edge of the web forward so that there will be a substantial area of the web lying beyond the point at which the leading end of the die will again strike the web. All of the material in advance of the line where the die will make contact during the next cycle will therefore be scrap.

Accordingly, there has been a need for a mechanism which, when combined with a rotary die cutter, reduces the amount of web material that lies beyond the point where the leading edge of the die, upon rotation of the die roll strikes the web, and thereby reduces the amount of scrap web material produced. That need was initially filled by the invention of our above application, which provides for retracting the severed leading end of the web from a position beyond the nip of the rotary die cutter to a position in such relation to the nip that the leading end of the web will lie just beyond the point at which the web will be engaged by the leading edge of the die on the next cutting cycle.

Specifically, the invention of that application provides a device which includes a floating part mounted to lie on the web so that when the web is pulled forward by the pressure between the die cylinder and the anvil cylinder blanket during a die cutting cycle, the web will be sufficiently tensioned to assure an essentially horizontal position with the floating part lying on top of it. As soon as the severing cut across the web is made upon completion of the particular die cycle, gravity will cause this floating part to return to a position below the line of feed of the web, thereby retracting the severed new leading end of the web by a predetermined amount.

This retraction preferably is such that the new leading end of the web will lie just beyond, in the direction of web feed, the line at which the web will be engaged by the leading edge of the die during the next cycle. Upon engagement of the web by the die at the start of the next cutting cycle, the web loop will then again be pulled straight, which will return the floating part to its raised position during the next die cutting cycle.

In the practice of that invention, therefore, it has been found possible to reduce the amount of scrap material very substantially as compared with prior practice, but as a general rule, not to eliminate all waste. Also, while the apparatus of that invention is most successful in operation with relatively flexible web materials, it tends to be less effective in conjunction with relatively stiff web materials unless it is relatively heavily weighted.

SUMMARY OF THE INVENTION

The primary objective of the present invention is to provide apparatus similar to that disclosed in our above application but representing a substantial improvement thereon in that it makes consistently possible at least the reduction of waste to so small a dimension lengthwise of the web as to fall within the acceptable tolerance range for the products cut from the web, and thereby effectively to eliminate all waste other than the scrap which surrounds the parts cut from the web, e.g. the material surrounding any part having a curved edge.

More specifically, in the apparatus of the invention, a control member which overlies the path of the web to the nip of the die and anvil rolls is raised and lowered between limit positions by a double-acting fluid pressure cylinder. The lower limit position of this part is accurately adjusted to assure that the cut leading end of the web will be retracted to an angular position on the anvil cylinder which coincides so accurately with the angular position where the leading end of the die will engage the anvil cylinder at the start of the next cutting that there will be only just enough of the web beyond the next cutting line for engagement of the leading edge of the die with the web.

The precision of this action is assured by a control, such for example as a rotary encoder, which actuates the fluid pressure cylinder in accordance with the angular position of the die on the die roll at the start and finish of each cutting stroke. As an example of the precision which can be achieved by the invention, as described in detail hereinafter, it has been found possible to cut circular pieces from a web by a die comprising two half circular knives in back to back relation such that during each cutting cycle, they cut out the trailing half of one pattern and the leading half of the next pattern, even when the web material is relatively stiff.

Details of the means by which the objectives and operating characteristics of the invention as summarized above are achieved will be more readily understood from the description of the preferred embodiment of the invention which follows.

DESCRIPTION OF THE PREFERRED EMBODIMENT

Figure 1:
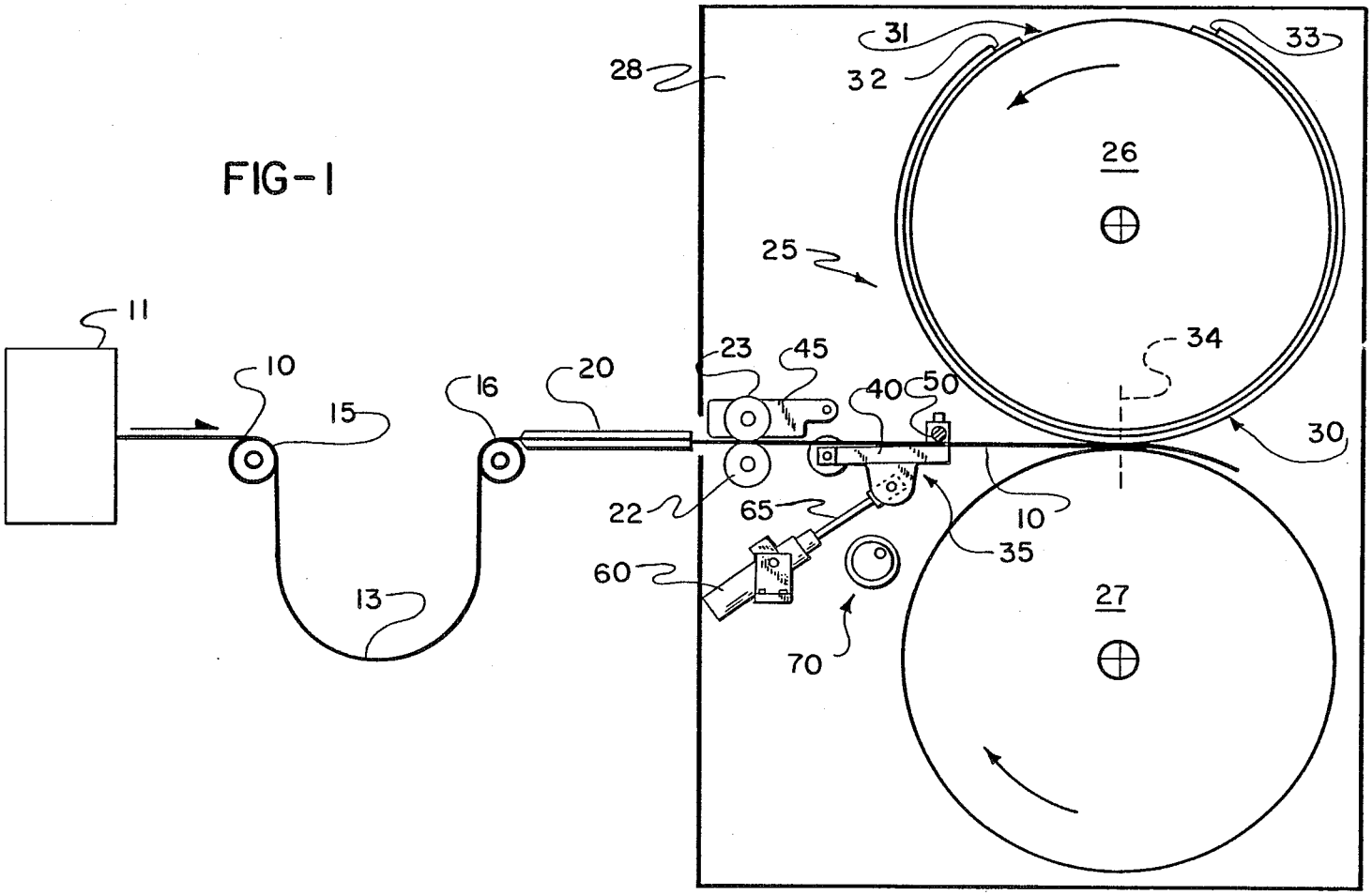
FIG. 1 is a schematic illustration of a die cutter line embodying the present invention and showing the parts during a die-cutting operation.

As shown in FIG. 1, the web 10 is supplied under tension from a roll or material processor shown schematically as a station 11 by conventional means such as driven pull rolls (not shown). The driving of the pull rolls is controlled in a conventional manner whereby a slack loop 13 is maintained in the web 10 between two idler rollers 15–16.

The web 10 drawn from the slack loop 13 is fed over a guide table or material support tray 20 and between a pair of pinch rolls 22–23 to the rotary die cutter 25, which comprises an upper die cylinder 26 and a lower anvil cylinder 27 rotatably mounted in the usual nip defining relation in suitable end frames 28. The anvil cylinder 27 may be a plain metal cylinder or may be provided with a conventional blanket of elastomeric or other protective material. The pinch rolls 22–23 are idler rolls in pressure engagement with the web 10, but they are provided with one-way clutches of any conventional construction which permit them to rotate only in the direction of advance movement of the web so that they hold the web against reverse movement toward the loop 13.

The movement of the web through the rotary die cutter 25 is effected by the direct pull applied to the web by the die 30 on the anvil cylinder 27, which grips the leading end portion of the web against the anvil cylinder 27. As illustrated in FIG. 1, the die 30 extends only part way around the circumference of die cylinder 26, so that each of the blanks to be cut from the web 10 by the die cutter 25 is shorter than the circumferential dimension of the die cylinder 26. There will therefore be a gap 31 on the surface of the die cylinder 26 between the trailing and leading edges of the die 30.

The die 30 may be of any steel rule or other conventional type, which will include a cut-off knife 32 on its trailing edge for cutting a completed blank and any scrap material on either side of it free of the web behind it. There may be a cut-off knife 33 at the leading edge of the die for cutting off the scrap material immediately in advance of the line on which this leading cut-off knife strikes the web, or the leading edge or edges 33 may continue the cutting of a blank which was partly cut by the trailing portion of the die during its previous cycle.

As described below, the leading edge knife 33 on the die 30 will engage the web on the surface of anvil cylinder 27 ahead of the nip line 34 of the two cylinders. Similarly, the trailing edge knife 32 will engage the web beyond the nip line 34. Inherently, therefore, unless some provision is made to prevent it, the portion of the web lying between those two positions at the end of the cutting portion of each cycle will become scrap.

During each portion of a cycle of the die cutter while the gap 31 is opposite the anvil cylinder, the die cutter is not applying a pulling force to the web. However, there will be a tendency for momentum to propel the cut leading end of the web forward. In addition, since the free leading portion of the web is resting on the constantly rotating surface of the anvil cylinder 27, frictional engagement therebetween will also cause forward movement of the leading end of the web.

As a result of this combination of forces, it has been found that unless special provision is made to prevent it, a substantial portion of the leading end of the web will travel beyond the nip line 34 of the two cylinders 26–27 before the leading end of the die 30 again engages the web. All this material which lies forward of the line where the knife 33 at the leading end of the die next engages the web will become scrap. The essential purpose of the present invention is to minimize the amount of that scrap by controlled retraction of the leading end of the web during that portion of each cycle of the die cutter when there is no pressure engagement between its two cylinders.

As schematically illustrated in FIG. 1, in accordance with the present invention, a controlled retraction device 35 is provided at a position spaced between the pressure rolls 22–23 and the two cylinders 26–27. The device 35 functions to retract that portion of the web material which has passed beyond the nip line 34 the die cylinder 26 and anvil cylinder 27 back toward the pressure rolls 22–23 as soon as the trailing edge knife 32 of the die 30 has released the web.

The primary structural member of the retraction device 35 comprises arm means shown as a generally rectangular table 40, which is preferably fabricated from appropriate lengths of square tubing for minimum weight purposes. This table 40 has a pivotal mounting 41 in each of a pair of bars 42–43 bolted or otherwise mounted on the inside faces of the end frames 28. These bars also support the rotational mounting for the lower one-way roll 22, while the upper roll 23 is rotatably mounted at each end in a bracket 45 pivotally mounted at 46 in the adjacent end frame 28 so that roll 23 can readily be lifted to facilitate threading of the web therethrough at the beginning of a die-cutting operation.

A cylindrical bar 50, which may be tubular for purposes of lightness, is mounted at the downstream corners of the table 40 by means of a pair of brackets 51 and screws 52. These brackets 51 are proportioned to provide a slot 55 between the bar 50 and the table 40, e.g. a slot 0.25 inch in height, through which the web 10 can pass freely.

Swinging movement of the table 40 about its pivotal mounting is effected and controlled by a double-acting fluid pressure cylinder 60, preferably a pneumatic cylinder, which is provided with a pivotal mounting 61 in a pair of brackets 62 on a base structure 63. It has been found convenient to use an air manifold as the base structure 63, with pressure air being supplied thereto from the usual plant source, and with suitable connections leading therefrom to the cylinder 60 as described below in connection with FIG. 7.

The piston rod 65 of cylinder 60 is pivotally connected at 66 between a pair of bearing blocks 67 bolted to the underside of the table 40 in such positions as to center the axis of the pivotal connection 66 with respect to the table 40. The size and stroke of the cylinder 60 must be sufficient to provide for swinging movement of the table 40 from the horizontal position shown in FIG. 1 to the lowered position shown in FIG. 2, with this lowered position being adjustable as described below.

Referring to FIGS. 2 and 4–6, the lowered position of the table 40 is established by its impact with an adjustable bumper assembly 70, the primary elements of which are a pair of elastomeric rings 71. Each of these rings is mounted on a cylindrical collar 72 having an eccentric bore by which it is mounted on a shaft 73 extending across the width of the machine. Each end of this shaft 73 is provided with a rotatable mounting 75 in a plate 77 bolted at 78 to the inside face of the adjacent end frame 28, and the effective position of these rings is adjustable through rotation of the shaft 73, as now described.

Figure 4:
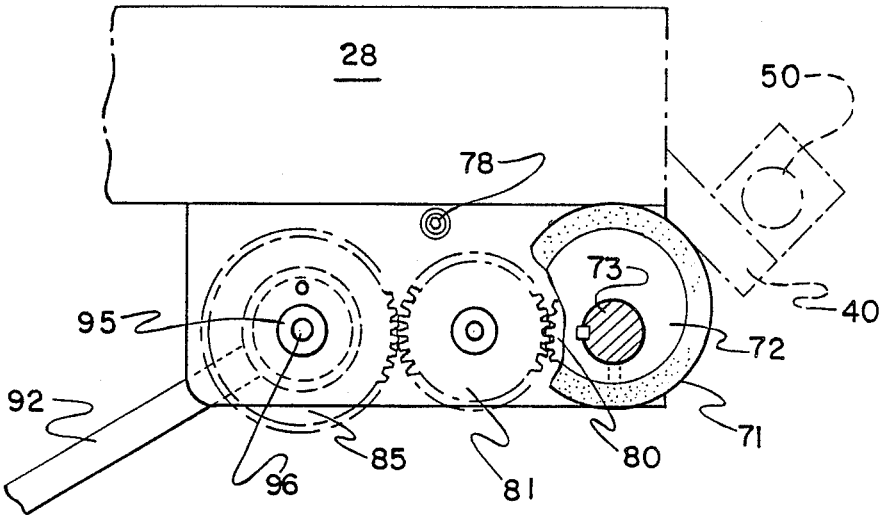
FIG. 4 is a fragmentary section on the line 4—4 in FIG. 2 and also of FIG. 6.
Figure 5:
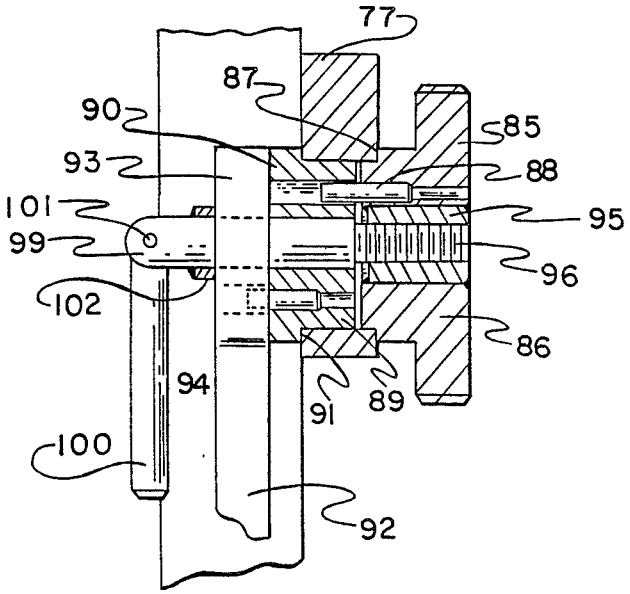
FIG. 5 is a section on the line 5—5 of FIG. 4.
Figure 6:
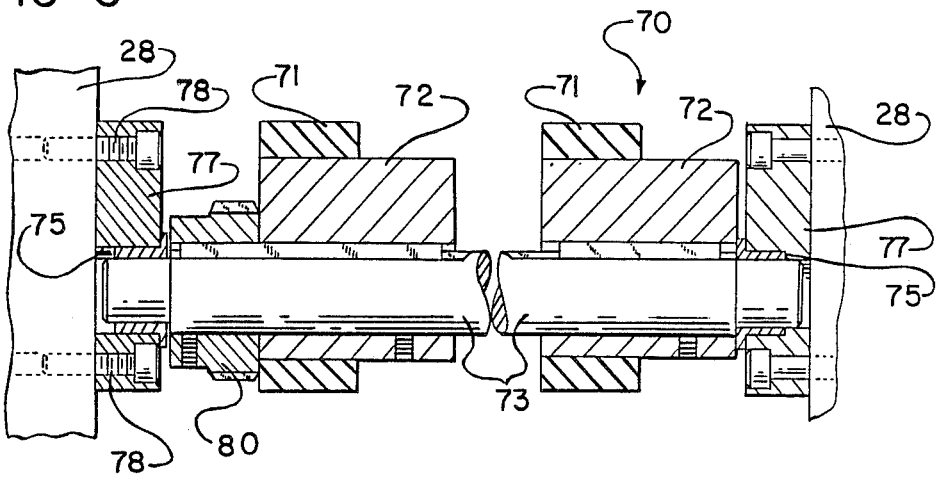
FIG. 6 is a section on the line 6—6 of FIG. 5.

Referring particularly to FIGS. 4–6, a gear 80 keyed on shaft 73 adjacent the plate 77 meshes with an intermediate gear 81 having a rotatable mounting in the plate 77. This gear 81 meshes with a third gear 85 having a compound mounting in plate 77 through which it can be as desired to adjust the angular position of shaft 73 and bumper rings 71, and through which it also can be firmly locked against rotation.

More specifically, the gear 85 includes a hub 86 which is journalled in the plate 77, but its penetration of plate 77 is limited by an annular shoulder 87 dimensioned to seat against the surface of plate 77. The gear 85 is also connected through a dowel pin 88 with the hub 89 of a collar 90 which is journalled in the opposite side of the plate 77 in concentric relation with gear 85, and which also includes a shoulder 91 dimensioned to seat on the opposite surface of plate 77 from shoulder 87. A lever 92 includes a hub 93 which is secured to collar 90 by a dowel pin 94, so that rotation of lever 92 will cause corresponding rotation of gear 85, and therefore of shaft 73 and bumpers 71 to change their effective positions with respect to the table 40.

As previously noted, provision is also made for locking the shaft 73 in any desired angular position of the bumper assembly 70. Referring to FIG. 5, a sleeve or bushing 95 is welded within a central bore in gear 85, and this busing is internally threaded to receive the threaded end 96 of a cylindrical rod 99 which is journalled in the collar 90 and the hub 93 of handle 92. A handle 100 is pivoted at 101 to the end of rod 99 to facilitate rotating this rod, and thereby rotating its threaded end 96 in the threaded bushing 95. A collar 102 is welded on rod 99, and the inner end of this collar abuts the hub 93 of lever 92 to limit relative movement of these parts toward each other.

It will now be apparent that whenever the rod 99 is rotated clockwise as viewed from the left in FIG. 5, the rotation of its threaded end 96 in the bushing 95 will cause the gear 85 and collar 90 to move axially toward each other, and thereby to move their respective shoulders 87 and 91 into clamping engagement with the plate 77.

Since this will clamp gear 85 against rotational movement, it will in turn clamp the bumper assembly 70, and specifically the bumper rings 71, in the corresponding angularly adjusted position of the eccentric wheels 72, thereby establishing the lowered limit position of the table 40 in contact with the bumper rings 71. Similarly, rotation of rod 99 in the opposite direction will release the clamped condition of gear 85 so that it can be rotated by the lever 92 for the purpose of changing the adjusted effective position of the bumper assembly 60.

Movement of the table 40 from its raised position to its lowered position occurs only at the end of each die cutting cycle and therefore when the leading end of the web 10 has been released by the last die knife. During the downward movement of table 40, the bar 50 thereon will pull down with it the leading portion of the web, thereby forming a second loop 105 in the web by retracting the leading end of the web in the direction opposite the continuing rotation of the anvil cylinder 27.

The extent of this retraction is determined by the effective position of the bumper assembly 70, which should be adjusted to establish that the retraction of the leading end of the web will bring it as precisely as possible to the angular position on the surface of the roll 27 where that surface will first be engaged by the leading edge of the die 30 at the start of the next cutting operation. It is therefore important that provision be made for initiating the downward movement of table 40 in accurately timed relation with the completion of each die cutting cycle.

In the apparatus of our above application, the retracting stroke of the floating member begins as soon as the web is cut off and is therefore no longer tensioned by the pulling force of the die and anvil cylinders. In accordance with the present invention, this result is obtained by positive control of the operation of the pneumatic cylinder 60 to initiate the downward movement of the table 40 in precisely timed relation with release of the leading end of the web by the trailing edge of the die.

It is possible to accomplish this control by monitoring the movement of the die 30 by a magnetic sensor, a proximity switch or an electric eye arrangement which determines the precise instant when the cutting stroke of the die is completed, and correspondingly controls operation of cylinder 60. Preferred results, however, have been obtained by means of an encoder and pulse counter as illustrated schematically in FIG. 7 and now described.

The encoder 110 is a commercial product, such for example as a 7000 Series ACCU-CODER manufactured by Encoder Products Co., Sand Point, Id. It is connected as indicated at 111 to be driven by the die roll 26 and is operative to emit a predetermined number of pulses during each rotation of the die cylinder, preferably a plurality of pulses for each degree of angular movement of the die cylinder. These pulses are in turn supplied as indicated at 112 to a presettable, multiple output counter 115 from which output lines 116 and 117 lead to the solenoids 118 and 119 that operate the four-way valve 120 controlling the supply of air from manifold 63 to the opposite ends of cylinder 60, by the air lines 121 and 122.

Figure 7:
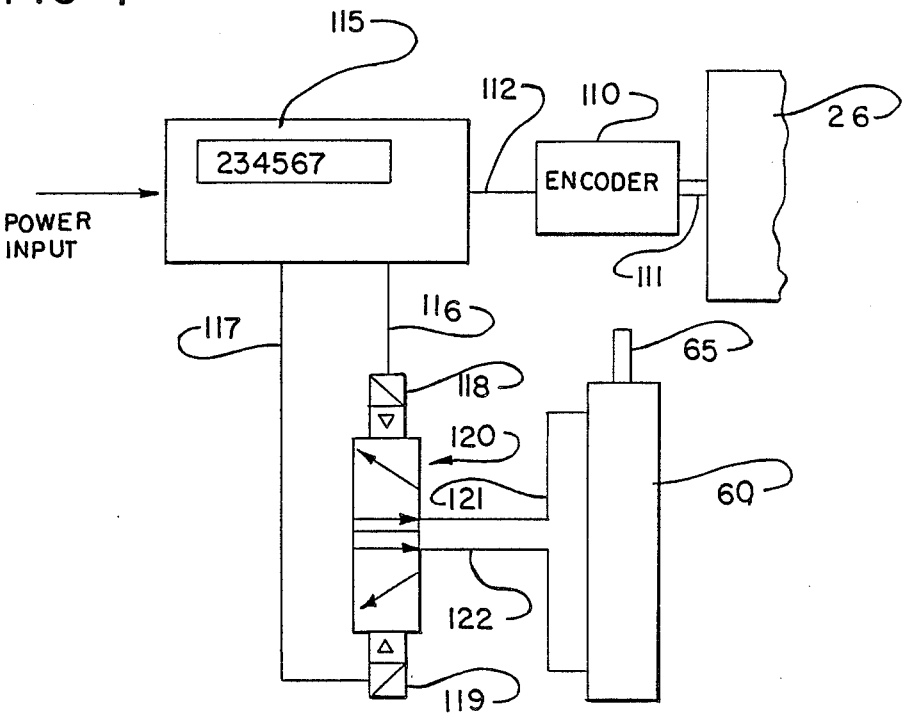
FIG. 7 is a diagrammatic view illustrating the control circuitry for the apparatus shown in FIGS. 1–6.

In initially setting up the system shown in FIG. 7 for a given series of die cutting operations, the operator first determines visually the angular position of the die roll 26 at the commencement of a die cutting cycle. That position of the die roll is then entered as the zero value in counter 115. Next, the operator determines the angular position of the die roll 26 at the instant of completing a cutting operation, and the corresponding pulse count is entered as Preset No. 2.

Figure 2:
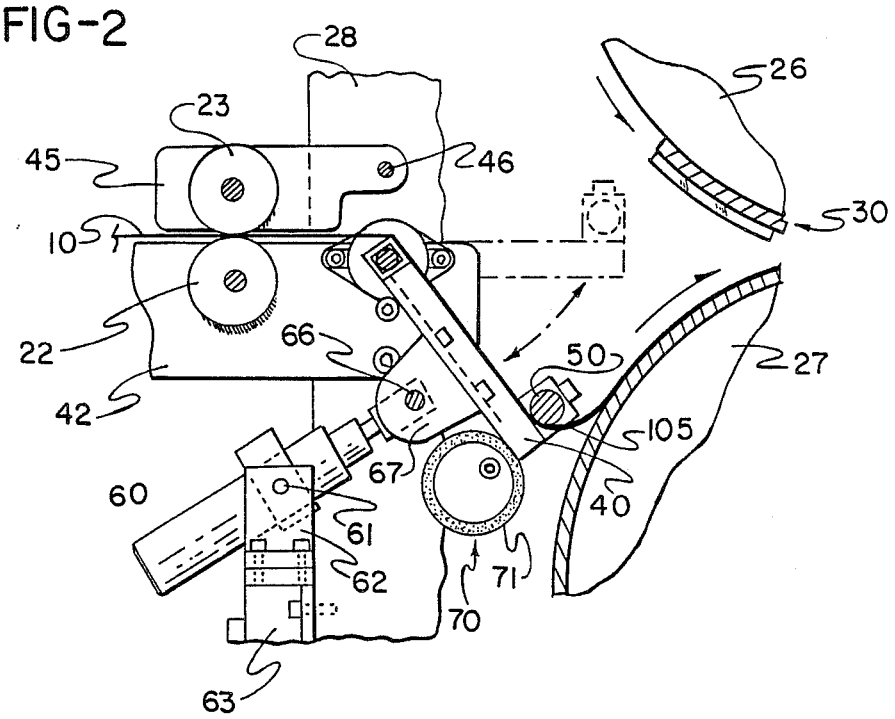
FIG. 2 is a fragment of FIG. 1 on a larger scale showing the relative positions of the parts during the interval between consecutive die cutting operations.
Figure 3:
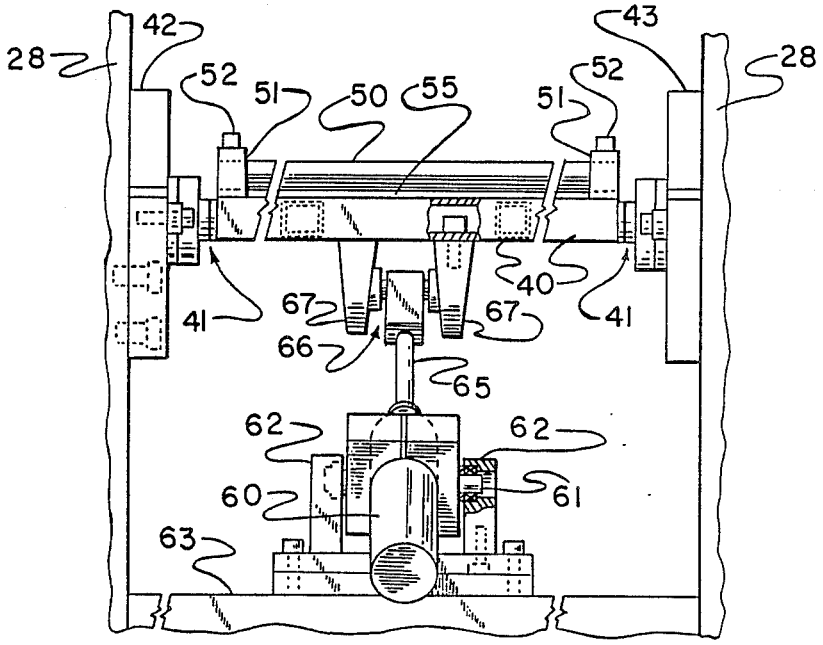
FIG. 3 is an elevation looking from left to right in FIG. 2.

In operation, during each die cutting cycle, the counter 115 will count pulses until it reaches the preset total corresponding to the end of a cut, and at that instant it will provide a signal on line 117 which will actuate solenoid 118 to cause cylinder 60 to retract the table 40 to its lowered position shown in FIG. 2. That movement of bar 55 will form the web loop 105 and thereby will retract the free leading end of web 10 to the angular position on anvil roll 27 where it will be engaged by the leading edge of the die 30 at the start of the next cutting cycle.

The table 40 is preferably not moved back to its raised position until after that next cutting cycle has started, because feeding of the web is effected by the pull thereon of the rolls 26 and 27 independently of the position of table 40. Therefore, the counter 115 is preferably set to provide a signal on line 116 to solenoid 119 as soon as the next cutting cycle has started, e.g. after it has counted two or three pulses from its zero start.

The resulting raising movement of table 40 to its horizontal position will introduce a corresponding amount of slack (loop 105) in that portion of the web between pinch rolls 22–23 and rolls 26–27, but this has no effect on the operation of this system because that slack will be taken up by the feeding action of rolls 26–27. Thereafter, the web will continue to be pulled directly from loop 13 through rolls 22–23 by rolls 26–27 until the current cutting cycle has been completed, whereupon the above-described sequence repeats.

Figure 8:
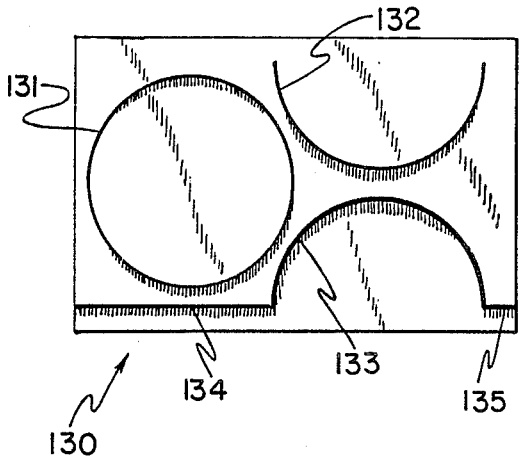
FIGS. 8 and 9 are diagrammatic views illustrating the operation of the apparatus of FIGS. 1–7 in cutting two rows of circular pieces from a single web.

FIG. 8 provides a diagrammatic illustration of the effectiveness of the apparatus of the invention as it has been proved in commercial use. As background for that illustration, it should be understood that the cutting of circular blanks from web stock necessarily results in substantial waste because of the amount of web material surrounding each such blank, particularly around each location where adjacent blanks approach each other.

The amount of waste for each circular blank can be significantly reduced if the blanks can be cut in two rows from a single web wherein the blanks are in staggered and interfitting relation. Such an operation, however, would require that the die consist of a circular knife and two semi-circular knives in back to back relation, and this in turn would require that the leading edge of the first of these semi-circular knives engage the web in accurate registry with the cut made on the web by the trailing semi-circular knife at the end of the previous cycle.

To explain this example in more detail, FIG. 8 shows the flat projection of a compound die 130 for carrying out this operation. This die 130 includes a circular knife 131 extending substantially the full length of the die on one side thereof, and a pair of semi-circular knives 132 and 133 adjacent the other side of the die which are in back to back relation with each other and nested relation with knife 131. The die 130 also includes cut-off knives 134 and 135 which define its trailing edge and are aligned with the diameter defined by the ends of the knive 133.

Figure 9:
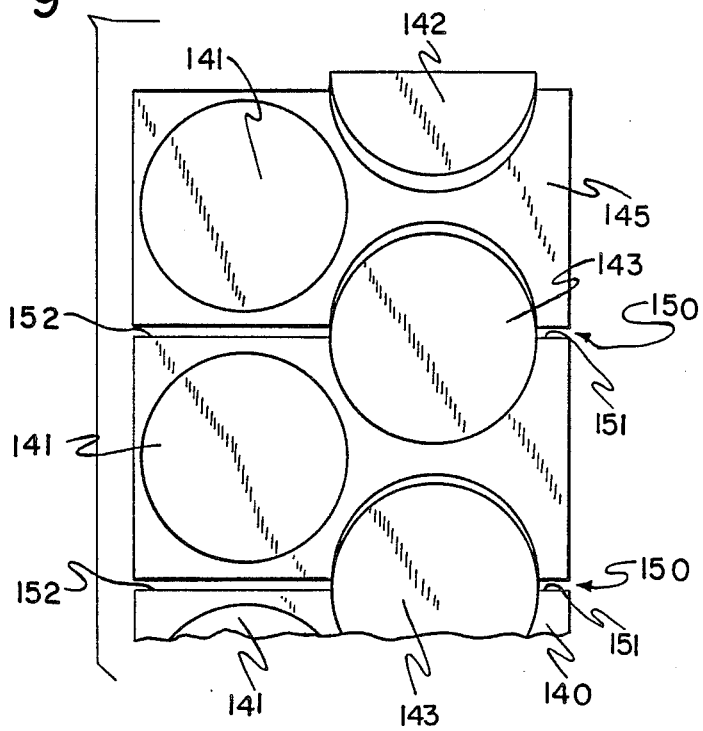

FIG. 9 illustrates diagrammatically the operation of this die assembly 130. In its first stroke on the web 140, it will cut out a full circular blank 141, a semi-circular blank 142 which will be waste, and the leading half of a circular blank 143. The blanks 141 and 142, and their associated scrap piece 145, will be cut free of the web, but the portion of the blank 143 will remain as a portion of the new leading end of the web.

As soon as this first cutting cycle has been completed, the apparatus of the invention will retract the leading end of the web to provide a gap 150 in FIG. 9 which causes the straight edge portions 151 and 152 along the leading end of the web to coincide with the line on which the die assembly 130 will engage the web at the start of the next cutting cycle. As a result, the semi-circular knife 132 will complete the cutting of the blank 143, the knife 131 will cut a second full circle blank 141, and the knife 143 will again cut one-half of a circular blank which will remain attached to the web after the blanks 141 and 142 at the scrap 145 have been cut therefrom.

The operation illustrated in FIG. 9 is a typical example of the accuracy obtainable with a rotary die cutter embodying the invention, which will consistently maintain a tolerance of plus or minus 0.125 inch between successive cuts from the same web. This consistent accuracy of operation makes it practical to cut cylindrical blanks in overlapping side-by-side relation from a single web as illustrated in FIG. 9, which has been found to effect a saving of the order of 20 % of the web material as compared with cutting a single row of blanks of the same size from an appropriately narrower web. Further, this saving will increase to approximately 25% in cutting three rows of circular blanks from the same web.

Accuracy of the quality represented in FIG. 9 is obtainable even if the web material is relatively stiff, such for example as is typified by chip board of sufficient flexibility to be handled in the form of a roll. Notwithstanding the stiffness of the web, the positive action of the cylinder 60 in pulling the web down into a second loop is adequate to overcome the stiffness of any web material subject to rotary die cutting.

While the method herein described, and the form of apparatus for carrying this method into effect, constitute preferred embodiments of this invention, it is to be understood that the invention is not limited to this precise method and form of apparatus, and the changes may be made in either without departing from the scope of the invention, which is defined in the appended claims

What is claimed is:

1. In a die cutter system for cutting successive blanks from advancing web material, said system including a pair of die and anvil rolls which are mounted in a frame in nip-defining relation and cooperate to grip and pull a leading end portion of the web forward during each cutting cycle thereof and which release the cut leading end of the web during a portion of each complete revolution, said system also including means for feeding the web to said rolls, and means for maintaining a slack loop of web between said feeding means and said rolls whereby said rolls grip and pull the web from said slack loop, apparatus for minimizing the scrap web material between successive blanks cut from the web comprising:

(a) one-way means at a position spaced between said loop and said rolls for holding the web against backward movement into said loop, (b) control means for the web positioned between said holding means and said nip and including arm means pivotally mounted in said frame for movement between upper and lower limit positions, (c) a bar carried by said arm means and adapted, in said upper limit of said arm means, to overlie the feed line for the web from said holding means to said nip, (d) whereby movement of said arm means to said lower limit position when said web is released from said rolls following a cutting cycle thereof will effect retraction of the cut leading end of the web, (e) means for adjusting the location in said frame of said lower limit position to adjust said retracting action of said arm means whereby the resulting retracted position of the cut leading end of the web will substantially coincide with the angular position on said anvil roll where said die roll will engage said anvil roll at the start of the next cutting cycle, (f) double acting fluid pressure means for moving said arm means between said limit positions thereof, and (g) means responsive to the angular position of said die roll during each cutting cycle of said rolls for effecting operation of said fluid pressure means.

2. Apparatus as defined in claim 1 wherein said responsive means comprises means for sensing the completion of each cutting cycle of said rolls, and means actuated by said sensing means for causing said fluid pressure means to move said arm means to said lower limit position substantially immediately upon completion of each said cutting cycle.

3. Apparatus as defined in claim 1 wherein said responsive means comprises means responsive to the completion of each cutting cycle of said rolls for causing said fluid pressure means to move said arm means to said lower limit position substantially immediately upon completion of said cutting cycle, and means responsive to the start of the next said cutting cycle for causing said fluid pressure means to move said arm means to said upper limit position during said next cutting cycle.

4. Apparatus as defined in claim 1 wherein said responsive means comprises means for determining the respective angular positions of said die roll at the start and completion of each cutting cycle of said rolls, and means responsive to said determining means for causing said fluid pressure means to move said arm means to said lower limit position substantially immediately upon completion of each said cutting cycle and causing said fluid pressure means to move said arm means to said upper limit position following the start of the next said cutting cycle.

5. The method of minimizing the scrap web material between successive blanks cut from advancing web material in a die cutter system including a pair of die and anvil rolls which are mounted in a frame in nip-defining relation and cooperate to grip and pull the leading end portion of the web forward during each cutting cycle thereof and which release the cut leading end of the web during a portion of each complete revolution, said system also including means for feeding the web to said rolls, and means for maintaining a slack loop of web between said feeding means and said rolls whereby said rolls grip and pull the web from said slack loop, said method comprising the steps of (a) holding the web against backward movement at a station in space between said loop and said rolls, (b) creating a second loop in the portion of the web between said station and said rolls substantially immediately upon completion of said cutting cycle to retract the cut leading end of the web, (c) controlling the size of said second loop to cause the retracted position of the cut leading end of the web to coincide with the angular position on said anvil roll where said die roll will engage said anvil roll at the start of the next cutting cycle, and (d) releasing said second loop after the start of said next cutting cycle.

* * * * *